US006027017A

United States Patent [19]

Kuhn et al.

[11] Patent Number: 6,027,017

[45] Date of Patent: Feb. 22, 2000

[54] CONTAINER APPARATUS AND METHOD FOR CONVERTING A SHIPPING CONTAINER INTO ONE OR MORE DISPLAY TRAYS

[75] Inventors: Wayne H. Kuhn, Palos Park; Steven C. Burau, Wheaton, both of Ill.

[73] Assignee: Stone Container Corporation, Chicago, Ill.

[21] Appl. No.: 09/204,646

[22] Filed: Dec. 2, 1998

[51] Int. Cl.[7] ..... B65D 5/54

[52] U.S. Cl. ..... 229/120.011; 53/485; 229/125.28; 229/125.32; 229/164

[58] Field of Search ..... 229/120.011, 125.28, 229/125.32, 164; 206/427; 53/467, 485, 487

[56] References Cited

U.S. PATENT DOCUMENTS

| | | | |
|---|---|---|---|
| 4,263,769 | 4/1981 | Hanazawa et al. | 53/448 |
| 4,533,052 | 8/1985 | Fruchey et al. | 229/120.011 |
| 4,871,067 | 10/1989 | Valenti | 229/164 |
| 5,076,491 | 12/1991 | Freudentahl et al. | 229/125.32 |
| 5,277,360 | 1/1994 | DeMott | 229/122 |
| 5,369,939 | 12/1994 | Moon et al. | 53/485 |
| 5,413,276 | 5/1995 | Sheffer | 229/120.011 |
| 5,419,431 | 5/1995 | Neuber et al. | 229/120.011 |
| 5,487,504 | 1/1996 | Baird | 229/164 |
| 5,718,337 | 2/1998 | Carr et al. | 229/164 |
| 5,950,911 | 9/1999 | Naughton et al. | 229/164 |

FOREIGN PATENT DOCUMENTS

| | | |
|---|---|---|
| 2196273 | 3/1974 | France . |
| 382645 | 12/1964 | Germany . |

*Primary Examiner*—Gary E. Elkins
*Attorney, Agent, or Firm*—Dick and Harris

[57] ABSTRACT

A container apparatus convertible from a shipping container having two or more adjacent trays into one or more display trays for the display of articles therewithin. The apparatus includes at least two trays and a tray cover. Each of the two trays includes a front panel, a back panel, two side panels and a bottom panel. Upon articulation, the height of the two side panels is greater than the height of at least one of the front and back panels. The tray cover includes two end panels, with at least one end panel having at least one tab member for positioning between the articles and at least one of the front and back panels, respectively, to secure the tray cover within each of the at least two trays.

23 Claims, 9 Drawing Sheets

Fig 3
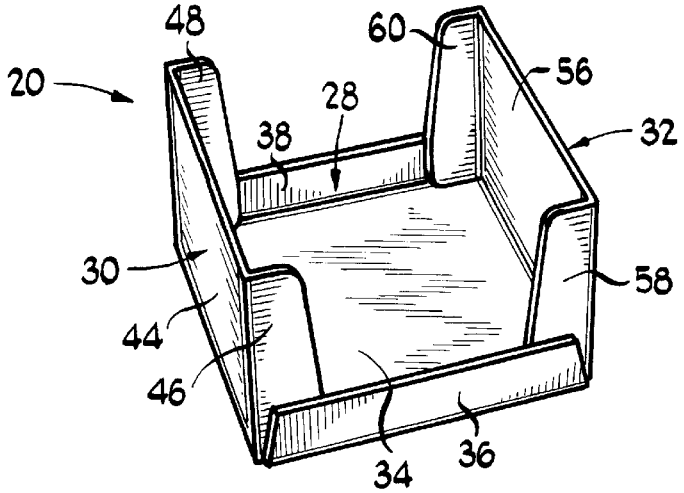
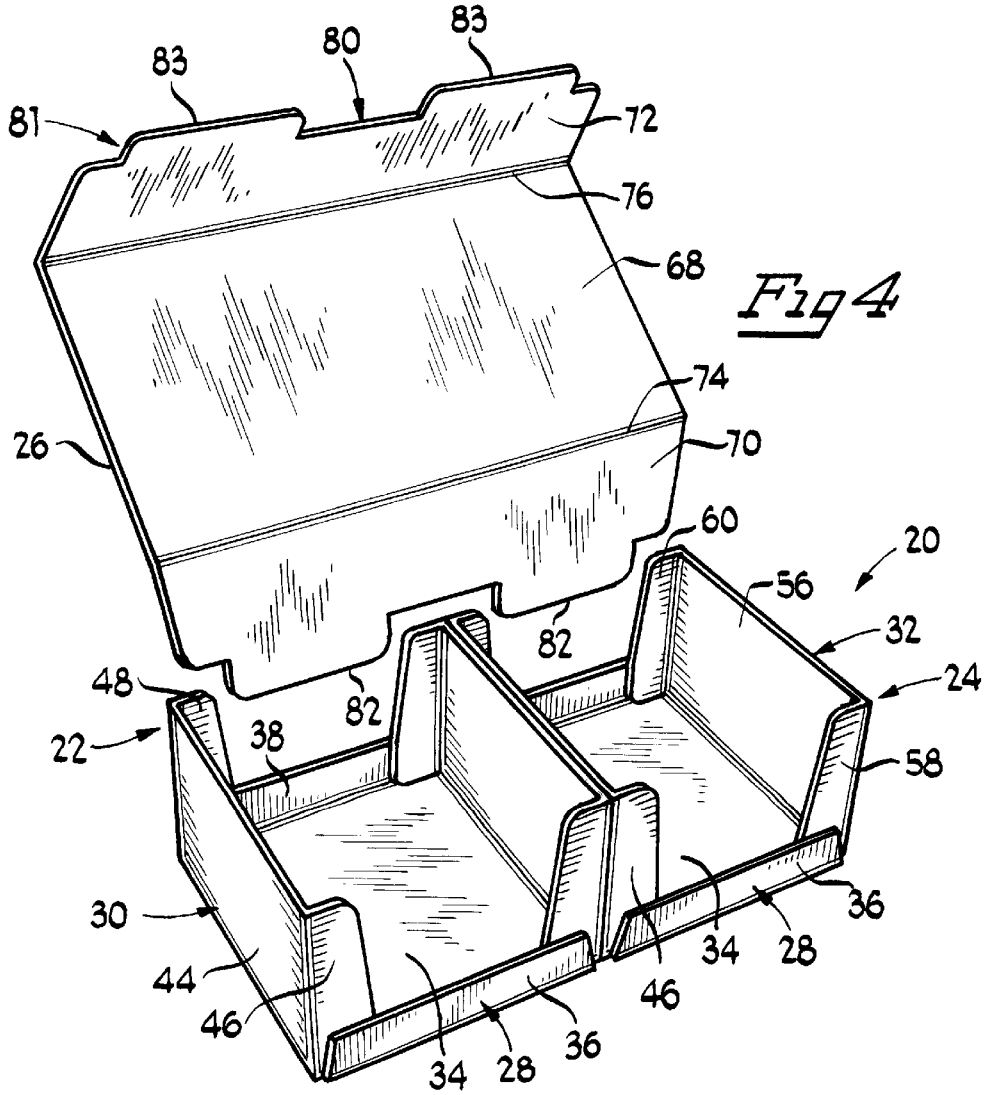
Fig 4

24
68
58
36
28
34
46
22
30
72
60
74
76
83
48
26
84
80
78
82
81
79
70
20
44

CONTAINER APPARATUS AND METHOD FOR CONVERTING A SHIPPING CONTAINER INTO ONE OR MORE DISPLAY TRAYS

BACKGROUND OF THE DISCLOSURE

1. Field of the Invention

The present invention is directed to tray-type container apparatuses and, more particularly, to a container apparatus convertible from a shipping container having two or more trays into one or more display trays. The present invention is also directed to a method for forming a container apparatus convertible from a shipping container having two or more trays into one or more display trays for point-of-purchase sales.

2. Background Art

Containers formed of corrugated paperboard are well-known in the art, particularly for shipping consumer products. Traditionally, many of these containers have included single tray-and-tray cover designs for shipping articles of manufacture. However, such configurations require a separate tray and a separate tray cover for each unit or group of articles to be shipped, and thus, increase handling costs and reduce handling efficiencies. Additionally, prior art containers often require the use of tear-away strips or panels that are usually discarded after shipping. These containers typically expose torn or jagged edges, and thus, are not aesthetically pleasing to the consumer. Further, these containers do not maximize both physical and visual access to their contents.

It is thus an object of the invention to provide a container apparatus that can easily convert a shipping container having two or more trays into one or more display trays for the containment and display of articles therewithin.

It is also an object of the invention to provide a container apparatus for shipping two or more display trays that reduces handling costs and increases handling efficiencies, while maximizing visual and physical access to contents, upon removal of a cover, without compromising containment integrity.

It is further an object of the invention to provide a shipping/display container apparatus with maximum stacking strength.

It is yet another object of the invention to provide a container apparatus with a tray cover that also serves as a display tray header.

It is further an object of the invention to provide a container apparatus with a perforated tray cover that separates two or more trays into two or more display trays.

These and other objects of the invention will become apparent in light of the present specification, claims and drawings.

SUMMARY OF THE INVENTION

The invention comprises a container apparatus convertible from a shipping container having two or more trays into one or more display trays for the containment and display of articles therewithin. Preferably, the container apparatus is formed of substantially flat blanks of material, such as corrugated paperboard.

The apparatus comprises at least two trays in side-by-side abutment upon articulation. Each of the at least two trays include a front panel, a back panel substantially parallel to and opposite the front panel, at least two side panels, a bottom panel and a tray cover. Preferably, the front panel and the back panel have substantially the same height and configuration. In one embodiment, the height of the front panel is greater than the height of the back panel. In another embodiment, the height of the back panel may be greater than the height of the front panel.

In a preferred embodiment, the at least two side panels are positioned between the front panel and the back panel respectively, with each of the at least two side panels in substantially parallel relationship to and opposite one another. One of the at least two side panels of one of the at least two trays is juxtaposed adjacent one of the at least two side panels of the other of the at least two trays so as to position the at least two trays in abutting side-by-side orientation. Each of the at least two side panels includes a side-front panel and a side-back panel in substantially opposed, parallel relationship with one another upon articulation. Preferably, the side-front and side-back panels have substantially the same height and as the at least two side panels.

In another embodiment, each of the at least two trays includes four side panels operably positioned between the front and back panels respectively, each of two side panels juxtaposed and overlapping the other of the two side panels to provide additional structural and stacking strength to each of the at least two trays.

In yet another embodiment, each of the at least two side panels of each of the at least two trays includes a corner-reinforcement member which comprises three contiguous region members which, upon articulation, form the corner-reinforcement member to provide additional structural and stacking strength to each of the at least two trays.

The bottom panel is hingedly attached to the front, back and at least two side panels, and upon articulation, each of the front, back and at least two side panels have a preferred height. The height of the at least two side panels is greater than the height of at least one of the front and back panels so as to allow articles contained therewithin to be visible for inspection and facilitated access. Preferably, the height of the at least two side panels is greater than the height of at least a portion of both of the front and back panels.

The tray cover includes a top panel, a first end panel and a second end panel opposite the first end panel. Preferably, the first end panel and the second end panel have substantially the same configuration, and at least one of the first and second end panels have at least one tab member. The tray cover further includes an attachment means for the other of the first and second end panels for securing the other of the first and second end panels of the tray cover to each of the at least two trays. The attachment means comprises either an attachment strip or at least one tab member. Preferably, the first end panel comprises an attachment strip and the second end panel comprises at least one tab member. Alternatively, the first end panel may comprise at least one tab member and the second end panel comprises at least one tab member.

In a preferred embodiment, each of the at least one tab member of the tray cover has two lobes. The lobes are capable of being configured for insertable engagement between the articles contained within the at least two trays and at least one of the front and back panels, respectively, in each of the at least two trays, to, in turn, releasably secure the tray cover within each of the at least two trays. Each of the two lobes may further include a releasable attachment member which is capable of releasably mating engagement with a portion of at least one of the front and back panels respectively, after insertion of the first and second end panels between the articles and the front and back panels respectively, of each of the at least two trays, and which remains engaged with the portion of the at least one of the front and back panels respectively, after the attached at least one of the first and second end panels is disengaged from the one of the front and back panels.

Preferably, at least a portion of the top panel of the tray cover includes printed advertising material. The tray cover may also include a rotatable display header which enables advertising material printed thereon to be visible to the consumer and to allow the tray cover to serve as a point-of-purchase display upon removal of at least one of the front and back panels from between the at least one of the front and back panels and the articles.

In a preferred embodiment, the tray cover includes a frangible perforation line. The frangible perforation line is oriented symmetrically about the tray cover so as to substantially coincide with and abut the at least two abutting side panels of the at least two trays and allows the shipping container to be separated in a facilitated manner into two or more display trays, without preliminarily removing the tray cover.

The invention further comprises a method for forming a container apparatus convertible from a shipping container having two or more trays into two or more display trays for the containment and display of articles therewithin. The method comprises the steps of: (1) forming a first tray and a second tray from at least one substantially flat blank of material for each, each of the first and second trays comprising a front panel, a back panel substantially parallel to and opposite the front panel, at least two side panels operably positioned between the front panel and the back panel respectively, each of the at least two side panels in substantially parallel relationship to and opposite one another, one of the at least two side panels of one of the at least two trays juxtaposed adjacent one of the at least two side panels of the other of the at least two trays so as to position the at least two trays in the abutting side-by-side orientation, each of the front, back and at least two side panels, upon articulation, having a height, the height of the at least two side panels being greater than the height of at least one of the front and back panels so as to allow articles contained therewithin to be visible for inspection and for facilitated accessibility, and a bottom panel operably associated with the front, back and at least two side panels; (2) forming a tray cover having a top panel, a first end panel and a second end panel opposite the first end panel, each of the first and second end panels having at least one tab member, the at least one tab member capable of being configured for insertable engagement between the articles contained within the at least two trays and at least one of the front and back panels, respectively, in each of the at least two trays to, in turn, releasably secure the tray cover within each of the at least two trays, and further having attachment means for the other of the first and second end panels for securing the other of the first and second end panels of the tray cover to each of the at least two trays ; (3) articulating the first tray; (4) articulating the second tray; (5) articulating the tray cover; (6) positioning the second tray adjacent the first tray so that the first and second trays are in side-by-side abutment; (7) filling the first and second trays with the articles; (8) inserting the at least one tab member of the first end panel of the tray cover between at least one of the front and back panels, and the contained articles respectively positioned within the first and second trays to, in turn, releasably secure the first end panel within each of the at least two trays; (9) attaching the second end panel of the tray cover to the other of the front and back panels to, in turn, releasably secure the second end panel to each of the at least two trays; and (10) the insertion of the at least one tab member of at least one of the first and second end panels substantially enclosing the tray cover within each of the at least two trays.

BRIEF DESCRIPTION OF THE DRAWINGS

FIG. 3 is a front perspective view of the tray blank of FIG. 1 after articulation into a single tray;

FIG. 4 is a front perspective view of the apparatus of FIGS. 1–3 after articulation, showing two trays with an articulated cover positioned in alignment thereabove;

DETAILED DESCRIPTION OF THE DRAWINGS

Figure 1:
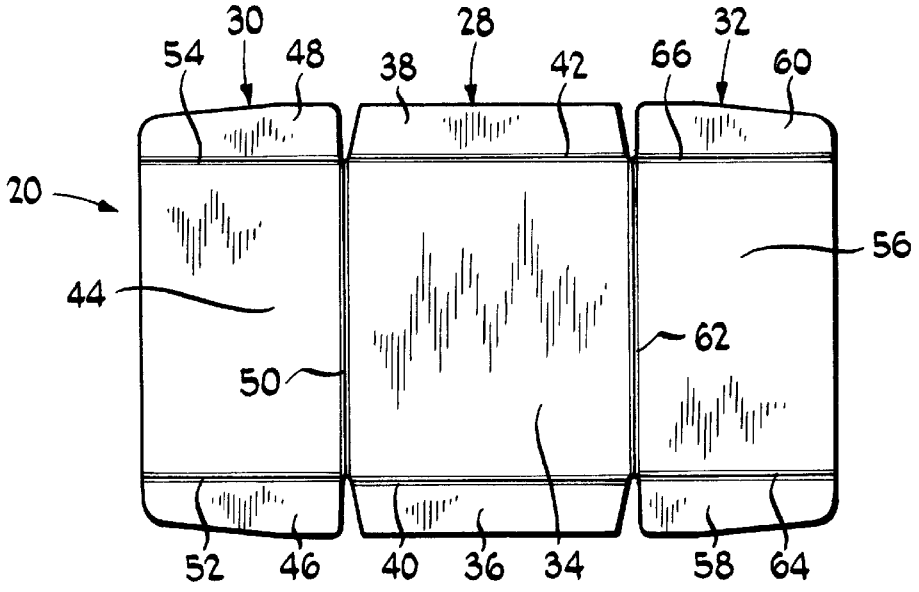
FIG. 1 is a top plan view of the tray blank according to one embodiment of the present invention.

While this invention is susceptible of embodiment in many different forms, there is shown in the drawings and will be described herein in detail, several specific embodiments, with the understanding that the present invention is to be considered as an exemplification of the principles of the invention and is not intended to limit the invention to the embodiments illustrated.

Figure 2:
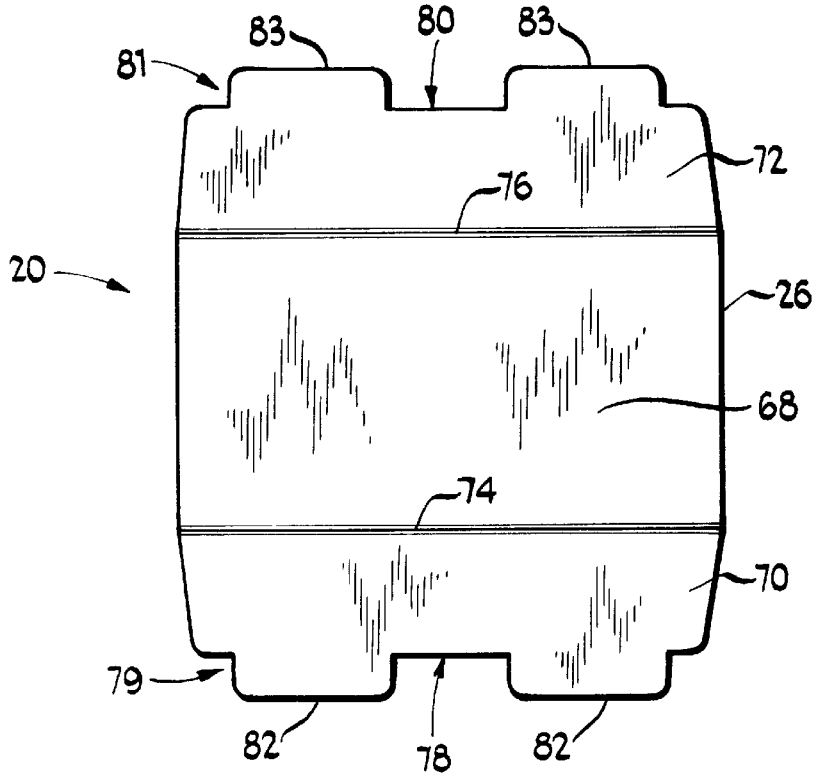
FIG. 2 is a top plan view of the tray cover blank according to one embodiment of the present invention.

As shown in FIGS. 1 and 2, container apparatus 20 is formed of substantially flat blanks of foldable, articulatable material. Preferably, apparatus 20 is constructed of paper material, such as corrugated paperboard. However, the use of different materials, such as plastic, among others, along with the use of differently proportioned blanks, is likewise contemplated.

Apparatus 20 is shown in FIGS. 1–5 as including first tray 22, second tray 24 and tray cover 26. Although apparatus 20 is shown as including at least two trays, apparatus 20 may include more than two trays in abutting side-by-side relationship. For example, apparatus 20 may include three trays in abutting side-by-side relationship with one tray cover. Alternatively, apparatus 20 may include four trays in abutting side-by-side relationship with one tray cover.

First tray 22 is shown in FIGS. 1 and 3 as including bottom panel assembly 28, first side panel assembly 30 and second side panel assembly 32. Preferably, assemblies 30 and 32 have substantially the same configuration, though the size ratios of the side panel assemblies are subject to choice. Likewise, first tray 22 and second tray 24 have substantially the same configuration, though the size ratios of the trays are subject to choice.

Bottom panel assembly 28 includes bottom panel 34, bottom front flap 36 and bottom back flap 38. Bottom front flap 36 emanates from bottom front fold line 40, and bottom back flap 38 emanates from bottom back fold line 42. Preferably, front flap 36 and back flap 38 have substantially the same configuration.

First side panel assembly 30 includes first side panel 44, first side front flap 46 and first side back flap 48. First side panel assembly 30 emanates from first side panel fold line 50. Similarly, first side front flap 46 emanates from first side front fold line 52, and first side back flap 48 emanates from first side back fold line 54. Preferably, front flap 46 and back flap 48 have substantially the same configuration. Additionally, the height of front flap 46 is preferably greater than the height of front flap 36 when apparatus 20 is articulated. Likewise, the height of back flap 48 is preferably greater than the height of back flap 38 when apparatus 20 is articulated. A smaller front flap 36 allows for the printing of indicia on the tray or, alternatively, enables a viewer to see the product name on articles 86 themselves, upon removal of tray cover 26, for inspection and, in turn, facilitated access by the consumer.

Second side panel assembly 32 includes second side panel 56, second side front flap 58 and second side back flap 60. Second side panel assembly 32 emanates from second side panel fold line 62. Likewise, second side front flap 58 emanates from second side front fold line 64, and second side back flap 60 emanates from second side back fold line 66. Additionally, the height of front flap 46 is preferably greater than the height of front flap 36 when apparatus 20 is articulated. Likewise, the height of back flap 48 is preferably greater than the height of back flap 38 when apparatus 20 is articulated.

As shown in FIGS. 2 and 4, tray cover 26 includes top panel 68, first end panel 70 and second end panel 72. First end panel 70 emanates from first end panel fold line 74, and second end panel 72 emanates from second end panel fold line 76. Additionally, first end panel 70 includes notch 78 and tab member 79. Likewise, second end panel 72 includes notch 80 and tab member 81. Tab members 79 and 81 further include lobes 82 and 83. Printed advertising material can be placed on the inside of top panel 68 and second end panel 72 to serve as a point-of-purchase display header.

While the panels and flaps are shown and described as preferably constructed from two monolithically-formed blanks, it is likewise contemplated that separate panels and flaps attached together may be used, if desired.

Figure 5:
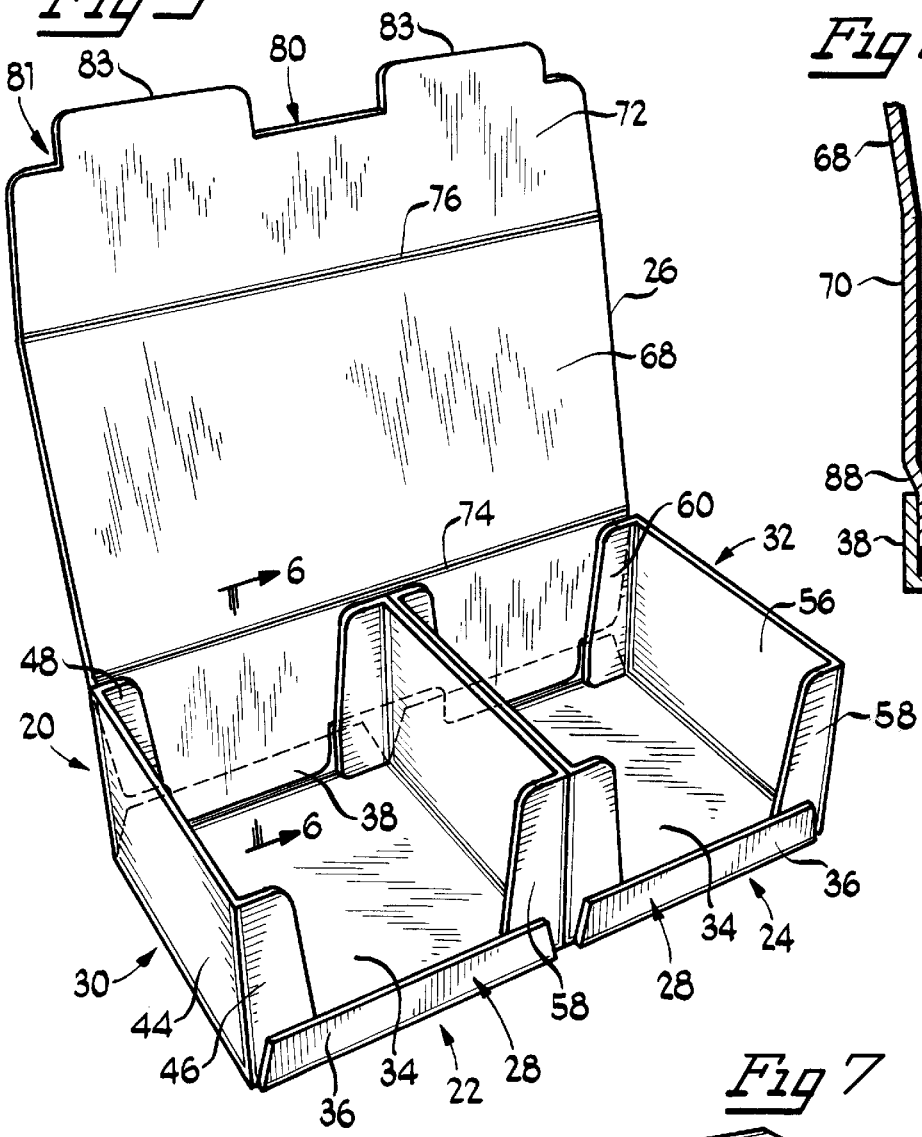
FIG. 5 is a front perspective view of the apparatus of FIG. 4 in which the tray cover has been inserted into the back opening of the tray for positioning between the articles and the back panel.
Figure 6:
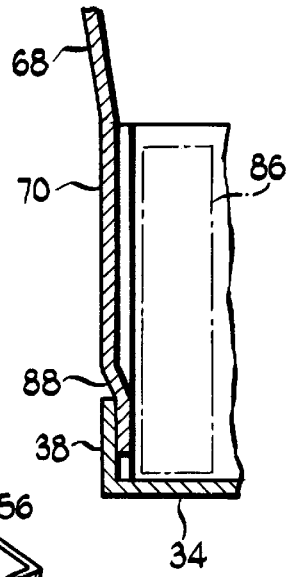
FIG. 6 is a cross-sectional view of the apparatus taken along lines 6—6 of FIG. 5 and looking in the direction of the arrows, showing the orientation of the tray cover's first end panel inside the back panel of the tray.

In operation, articles 86 are positioned within first and second trays 22 and 24 upon articulation. Articles 86 may be various shapes and may include soups, noodles, dry food mixes, dog food, paper goods and/or beverages, among others. As shown in FIGS. 4 and 5, lobe 82 of first end panel 70 is inserted inside bottom back flap 38 of first tray 22 to secure end panel 70 therewithin. Simultaneously, lobe 82 of first end panel 70 is inserted inside bottom back flap 38 of second tray 24 to likewise secure end panel 70 therewithin. FIG. 6 illustrates the connection between bottom back flap 38 and first end panel 70. Taper 88 may be pre-formed (by machine) prior to insertion between back flap 38 and articles 86. Alternatively, taper 88 may be manually manipulated prior to insertion between back flap 38 and articles 86.

Figure 7:
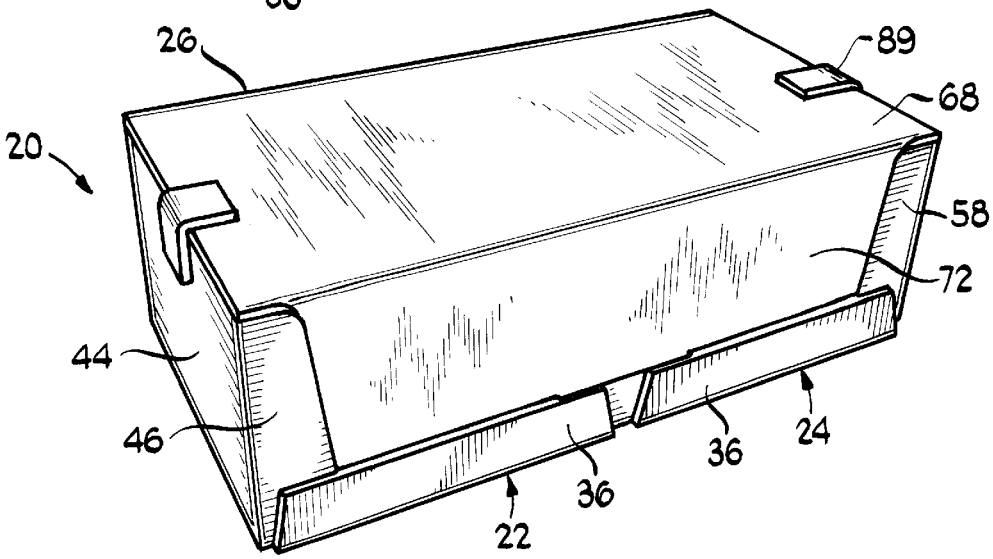
FIG. 7 is a front perspective view of the apparatus of FIGS. 5 after the tray cover has been fully secured at both end panels within the individual trays.

Next, and as shown in FIGS. 5 and 7, lobe 83 of second end panel 72 is inserted inside bottom front flap 36 of first tray 22 to secure end panel 72 therewithin. Simultaneously, lobe 83 of end panel 72 is inserted into bottom front panel 36 of second tray 24 to likewise secure end panel 72 therewithin. Moreover, tray cover 26 may be maintained within trays 22 and 24 by interference fit. Alternatively, tray cover 26 may be secured to trays 22 and 24 by adhesion, such as tape or glue (see FIG. 19), or by the use of "L-shaped" clips or glue strips 89 (see FIG. 7). However, the use of other securement means, such as stapling, is likewise contemplated.

Although tray 22 and tray 24 are preferably maintained in side-by-side abutment by attachment to tray cover 26, they may be held in their juxtaposed position by strips of adhesive tape across the front and back panels of the trays respectively. Furthermore, small glue spots between the adjacent side walls of tray 22 and tray 24, respectively, will maintain the trays in the position shown in FIGS. 4 and 5. Additionally, a band that extends around the circumference of the trays may be used to maintain the trays in their juxtaposed position.

After securing tray cover 26 to first and second trays 22 and 24 respectively, apparatus 20 can be shipped to its ultimate destination, such as a retailer. Upon arrival, apparatus 20 can be convertible from a shipping container to a point-of-purchase display tray by removing second end panel 72 from bottom front flap 38 which, in turn, returns apparatus 20 to the position shown in FIG. 5. In such a configuration, tray cover 26 may serve as a point-of-purchase display header.

Figures 8, 9, 10:
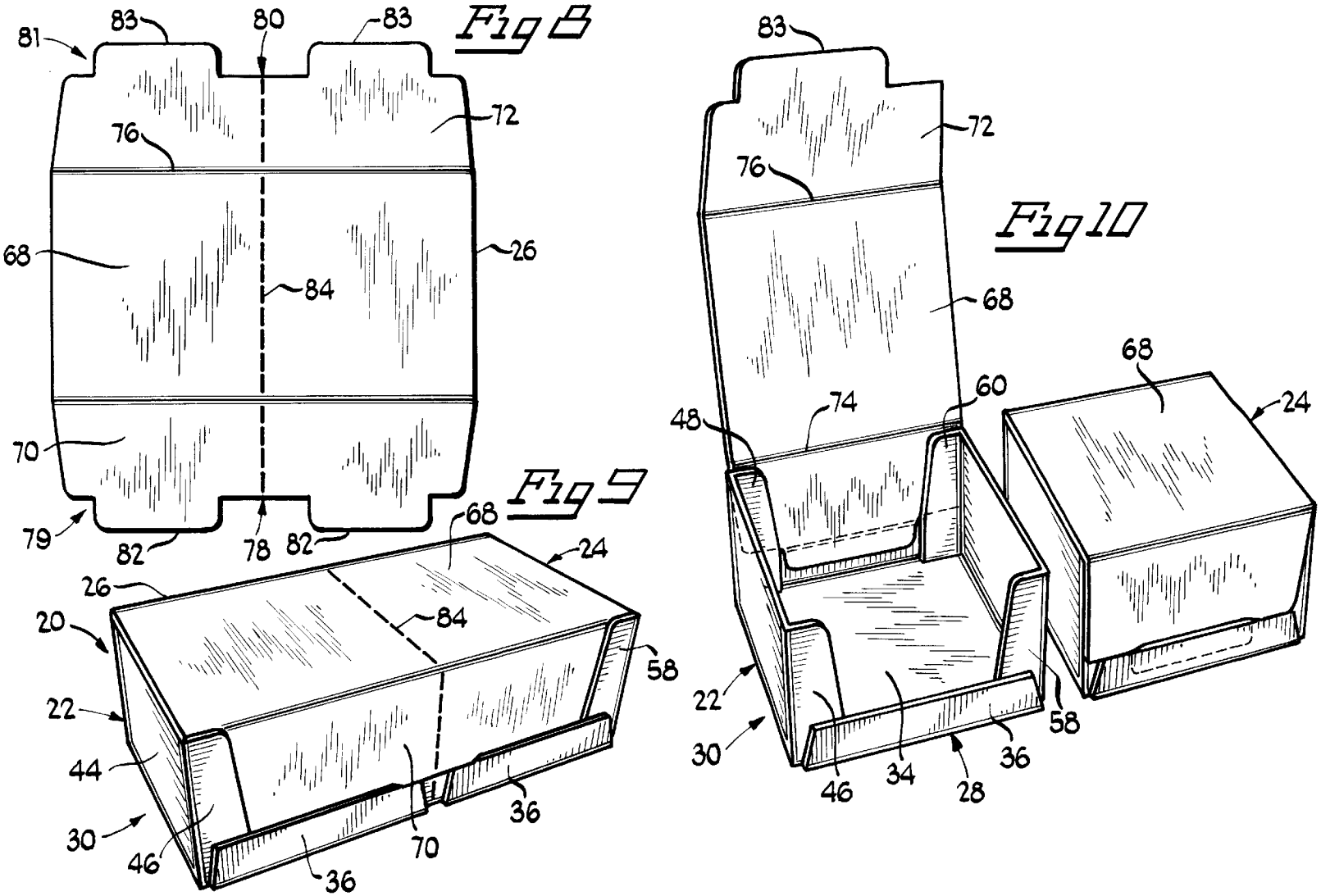
FIG. 8 is a top plan view of a frangible, perforated tray cover blank according to another embodiment of the present invention.
FIG. 9 is a front perspective view of the perforated tray cover of FIG. 8 after the tray cover has been secured within the individual trays.
FIG. 10 is a front perspective view of the apparatus of FIG. 9 after the tray cover has been perforated, separating the apparatus into two display trays while still covering the content of each.
Figure 11:
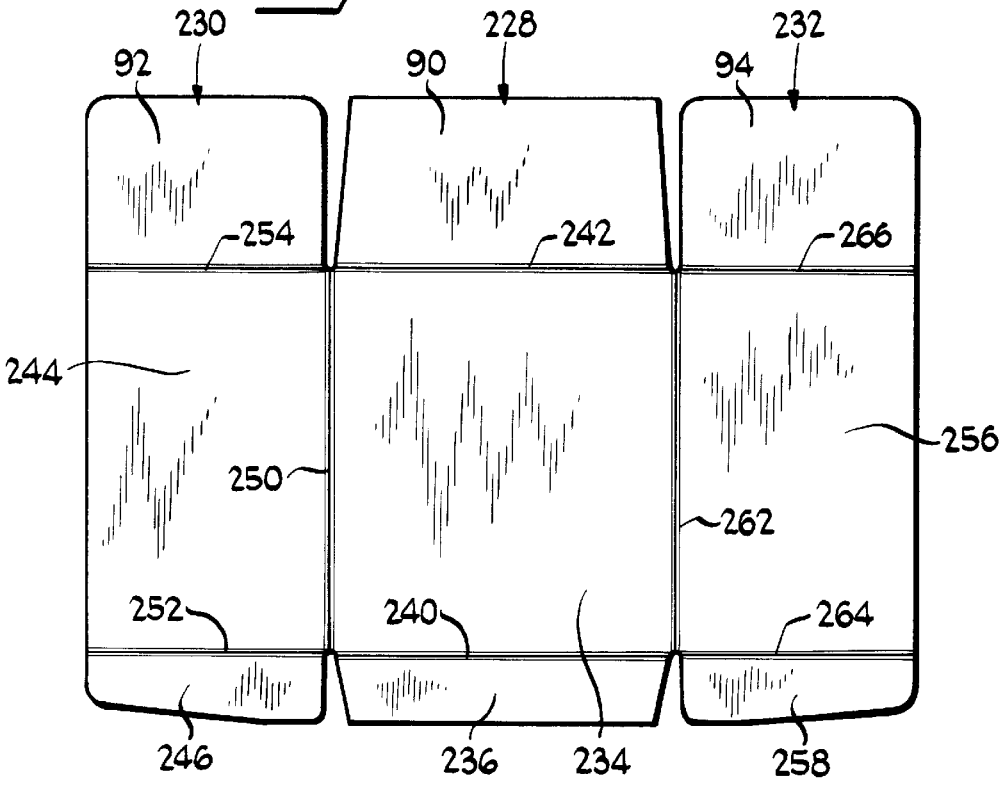
FIG. 11 is a top plan view of the tray blank according to another embodiment of the present invention.

In another embodiment, and as shown in FIGS. 8 and 9, tray cover 26 may include frangible perforation line 84. Preferably, frangible perforation line 84 is symmetric about tray cover 26 so as to substantially coincide with adjacent side panels of first and second trays 22 and 24. If it is desired to separate trays 22 and 24 prior to point-of-purchase display in the store, frangible perforation 84 allows apparatus 20 (see FIG. 10) to be easily separated into two display units, without preliminarily removing the tray cover.

Figure 12:
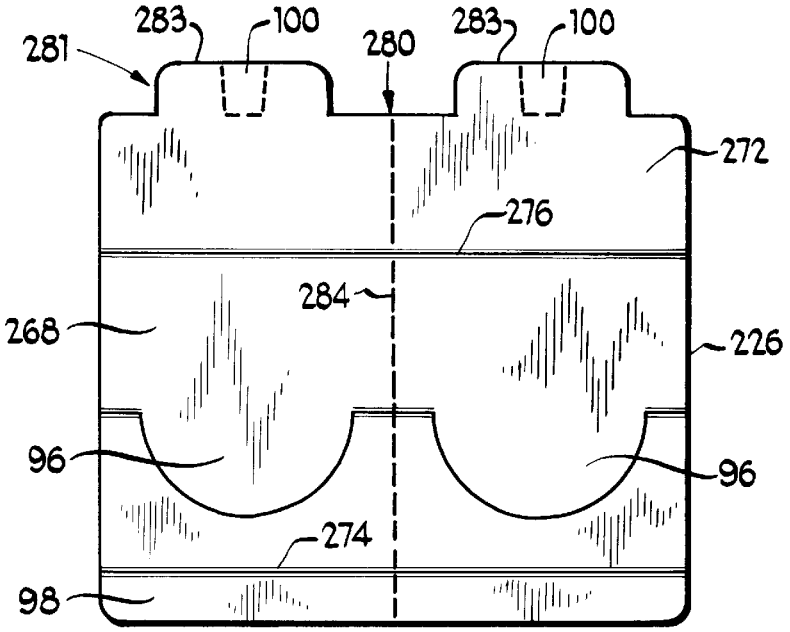
FIG. 12 is a top plan view of the tray cover blank according to another embodiment of the present invention.
Figure 13:
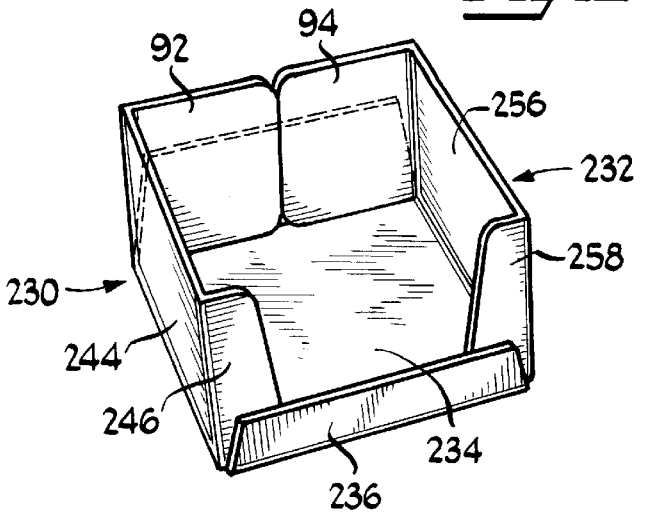
FIG. 13 is a front perspective view of the tray blank of FIG. 11 after articulation into a single tray.
Figure 14:
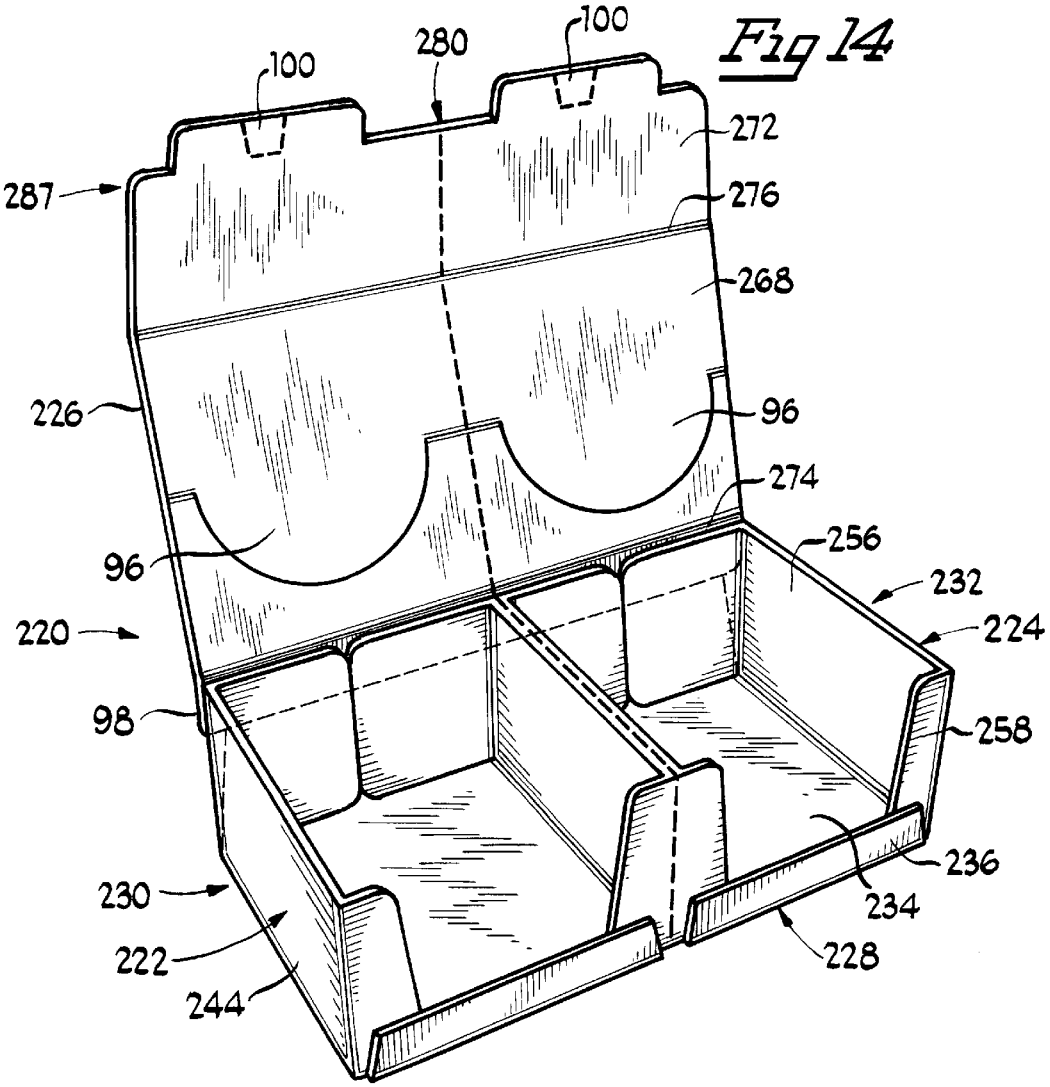
FIG. 14 is a front perspective view of the apparatus of FIGS. 11–13 after articulation, in which the tray cover has preliminarily been secured to the back of the tray.
Figure 15:
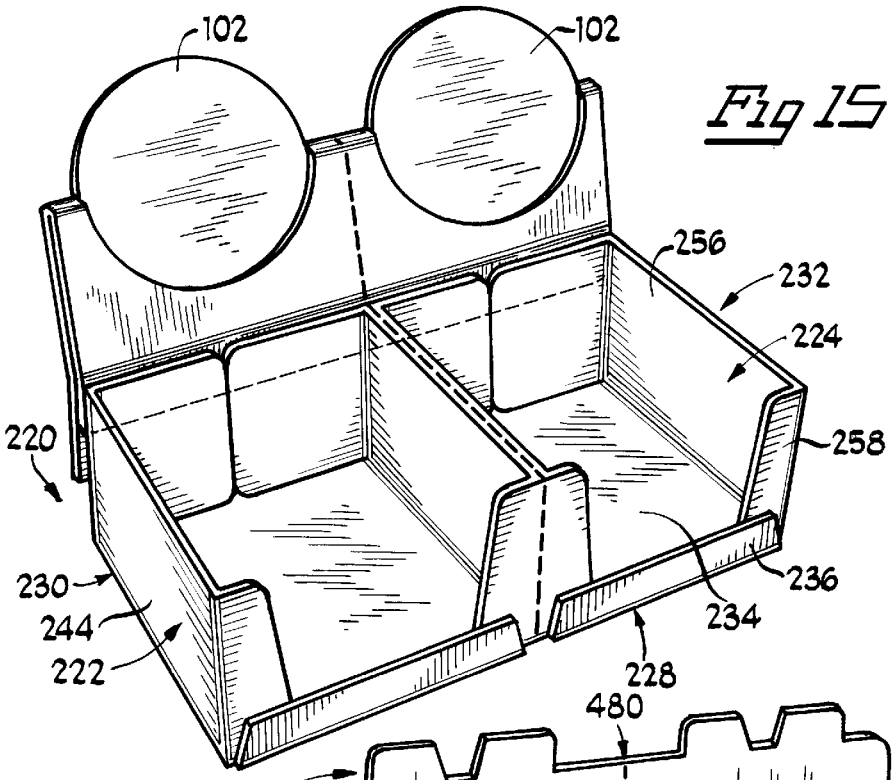
FIG. 15 is a front perspective view of the apparatus of FIG. 14 after the display headers have been rotated to display printed material on the tray cover.

In a further embodiment, and as shown in FIGS. 11–15, bottom panel assembly 228 includes bottom back support panel 90. Similarly, first side panel assembly 230 includes first side back support panel 92 and second side panel assembly 232 includes second side back support panel 94. As shown in FIGS. 13 and 14, upon articulation, support panels 90, 92 and 94 enclose and maintain articles 86 within first and second trays 222 and 224. Preferably, support panels 92 and 94 have substantially the same configuration, though the size ratios of the support panels are subject to choice. Moreover, the height of support panels 92 and 94 is greater than the height of support panel 90 when apparatus 220 is articulated.

As shown in FIG. 12, tray cover 226 also may include display region 96, end panel 98 and releasable attachment member 100. End panel 98 may be secured to first and second side back support panels 92 and 94 by adhesion, such as tape or glue (see FIG. 14). However, the use of other securement means, such as stapling, is likewise contemplated. Display header 102 (see FIG. 15) is formed by rotating display region 96 one hundred and eighty degrees (180°) counterclockwise from its original position, to enable advertising material printed thereon to be visible to the consumer and to allow tray cover 226 to serve as a point-of-purchase display upon removal of at least one of the front and back panels from between the at least one of the front and back panels and the articles.

Figure 16:
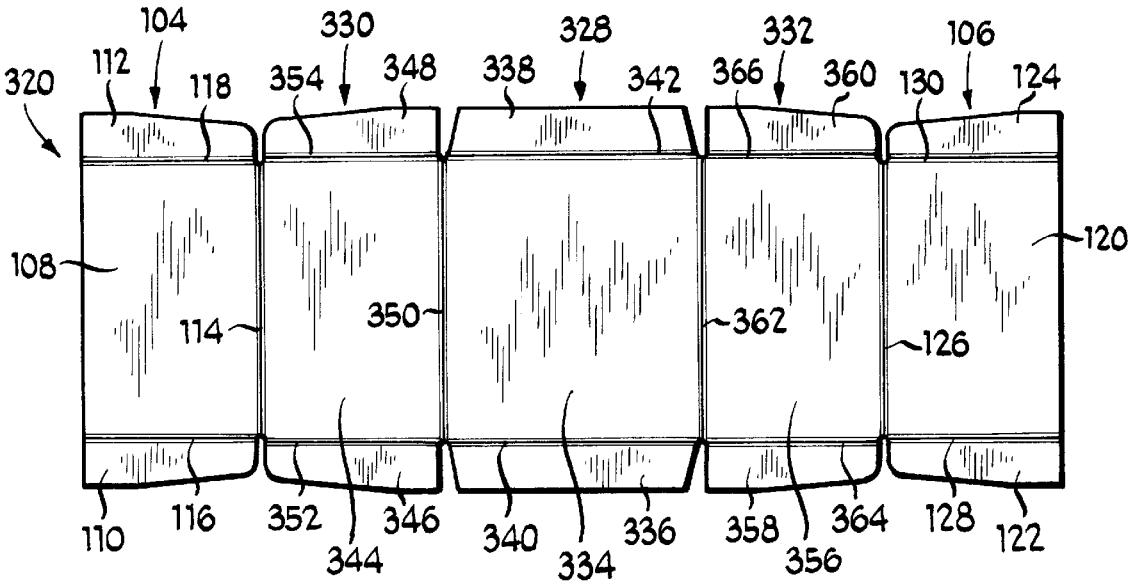
FIG. 16 is a top plan view of the tray blank according to a further embodiment of the present invention.

In another embodiment, and as shown in FIG. 16, each of the at least two trays may include third side panel assembly 104 and fourth side panel assembly 106. Assemblies 104 and 106 provide additional structural strength to apparatus 320, as well as additional stacking strength. Preferably, assemblies 104 and 106 have substantially the same configuration, though the size ratios of the third and fourth side panel assemblies are subject to design choice.

Third side panel assembly 104 includes third side panel 108, third side front flap 110 and third side back flap 112. Third side panel assembly 104 emanates from third side panel fold line 114. Similarly, third side front flap 110 emanates from third side front fold line 116, and third side back flap 112 emanates from third side back fold line 118. Preferably, front flap 110 and back flap 112 have substantially the same configuration. Additionally, the height of front flap 110 is preferably greater than the height of front flap 336 when apparatus 320 is articulated. Likewise, the height of back flap 112 is preferably greater than the height of back flap 338 when apparatus 320 is articulated. A smaller front flap 336 allows for the printing of indicia on the tray or, alternatively, enables a viewer to see the product name on articles 86 themselves, upon removal of tray cover 326, for inspection and, in turn, facilitated access by the consumer.

Fourth side panel assembly 106 includes fourth side panel 120, fourth side front flap 122 and fourth side back flap 124. Fourth side panel assembly 106 emanates from fourth side panel fold line 126. Likewise, fourth side front flap 122 emanates from fourth side front fold line 128, and fourth side back flap 124 emanates from fourth side back fold line 130. Additionally, the height of front flap 122 is preferably greater than the height of front flap 336 when apparatus 320 is articulated. Likewise, the height of back flap 124 is preferably greater than the height of back flap 338 when apparatus 320 is articulated.

Figure 17:
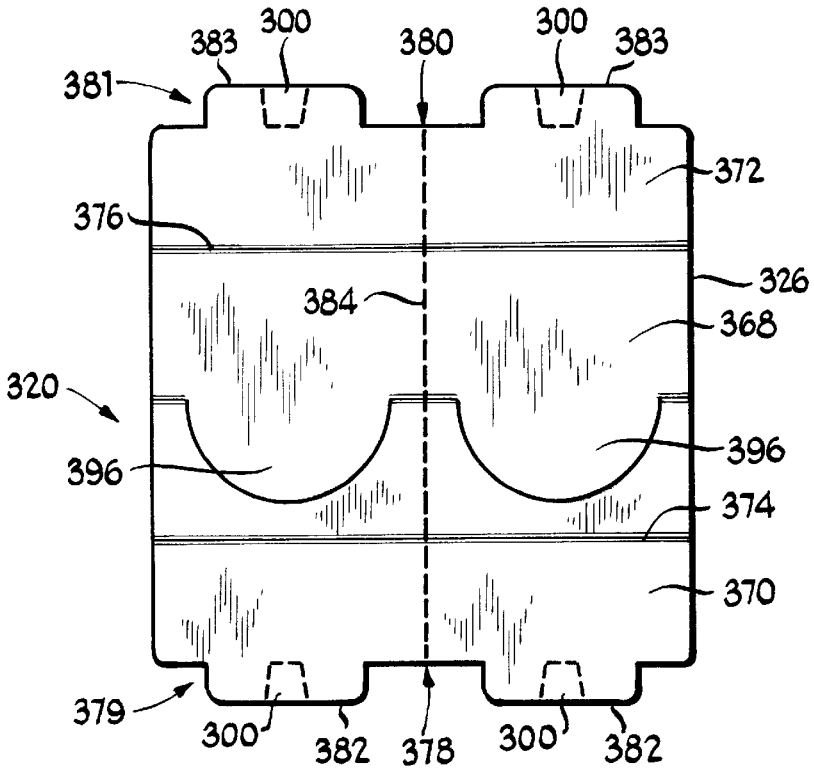
FIG. 17 is a top plan view of the tray cover blank according to a further embodiment of the present invention.

FIG. 17 shows an alternative tray cover 326 for attachment to each of the at least two trays. Tray cover 326 includes display region 396 and releasable attachment member 300. A display header is formed by rotating display region 396 one hundred and eighty degrees (180°) counterclockwise from its original position, to enable advertising material printed thereon to be visible to the consumer and to allow tray cover 326 to serve as a point-of-purchase display.

Figure 18:
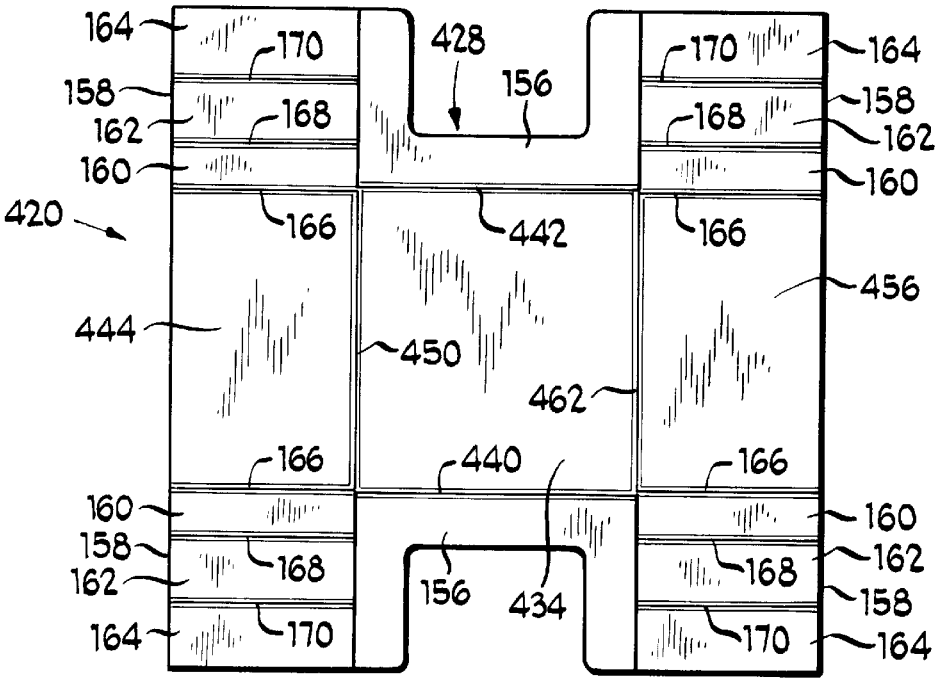
FIG. 18 is a top plan view of the tray blank according to yet another embodiment of the present invention.

In yet another embodiment, and as shown in FIG. 18, each of the at least two trays may comprise corner-reinforced trays. Each tray includes two U-shaped members 156 that form the front and back panels, respectively. Each tray also includes corner reinforcement member 158, which each further includes first corner region member 160, second corner region member 162 and third corner region member 164. First region 160 emanates from first corner fold line 166. Similarly, second region 162 emanates from second corner fold line 168, and third region 164 emanates from third corner fold line 170. Preferably, regions 160, 162 and 164 have substantially the same height when apparatus 420 is articulated. Further, each tray includes four substantially identical corner members 158.

Figure 19:
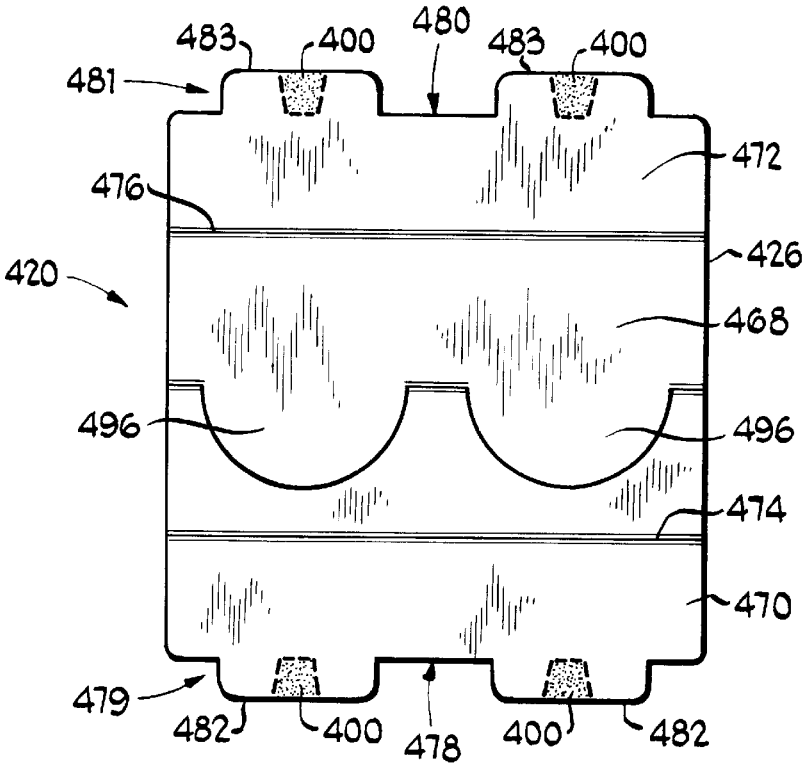
FIG. 19 is a top plan view of the tray cover blank according to yet another embodiment of the present invention.

FIG. 19 shows an alternative tray cover 426 for attachment to each of the at least two trays. Tray cover 426 includes display region 496 and releasable attachment member 400. A display header is formed by rotating display region 496 one hundred and eighty degrees (180°) counterclockwise from its original position, to enable advertising material printed thereon to be visible to the consumer and to allow tray cover 426 to serve as a point-of-purchase display. Preferably, tray cover 426 is secured to each of the at least two trays by applying glue to each releasable attachment member 400 prior to attachment of tray cover 426 to each of the at least two trays.

Figure 20:
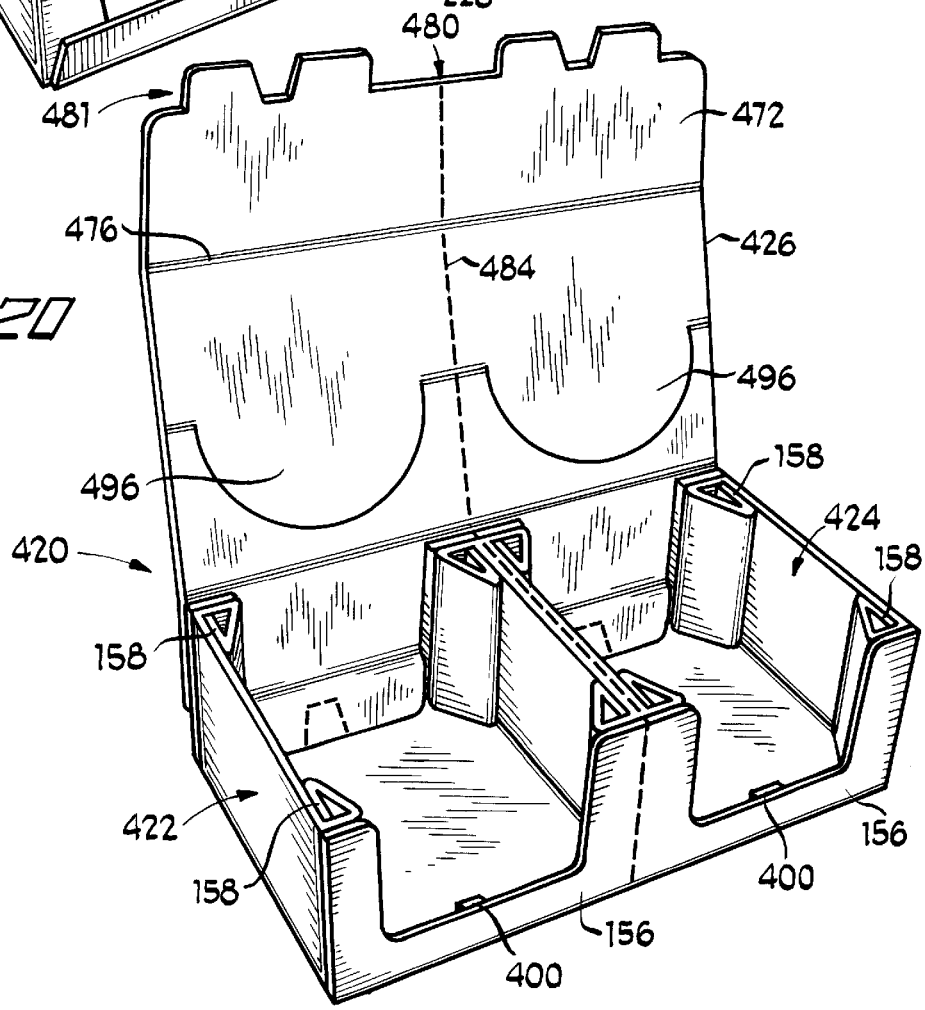
FIG. 20 is a front perspective view of the apparatus of FIGS. 18–19 after articulation, in which the tray cover has preliminarily been inserted into the back opening of the tray for positioning between the articles and the back panel.

As shown in FIG. 20, upon articulation, each of the corner members 158 form a tri-fold, triangular-shaped support that increases the structural support of trays 422 and 424, while also providing additional stacking strength to each tray.

The invention further comprises a method for forming a container apparatus convertible from a shipping container having two or more trays into two or more display trays for the containment and display of articles therewithin. The method comprises the steps of: (1) forming a first tray and a second tray from at least one substantially flat blank of material for each, each of the first and second trays comprising a front panel, a back panel substantially parallel to and opposite the front panel, at least two side panels operably positioned between the front panel and the back panel respectively, each of the at least two side panels in substantially parallel relationship to and opposite one another, one of the at least two side panels of one of the at least two trays juxtaposed adjacent one of the at least two side panels of the other of the at least two trays so as to position the at least two trays in the abutting side-by-side orientation, each of the front, back and at least two side panels, upon articulation, having a height, the height of the at least two side panels being greater than the height of at least one of the front and back panels so as to allow articles contained therewithin to be visible for inspection and for facilitated accessibility, and a bottom panel operably associated with the front, back and at least two side panels; (2) forming a tray cover having a top panel, a first end panel and a second end panel opposite the first end panel, each of the first and second end panels having at least one tab member, the at least one tab member capable of being configured for insertable engagement between the articles contained within the at least two trays and at least one of the front and back panels, respectively, in each of the at least two trays to, in turn, releasably secure the tray cover within each of the at least two trays, and further having attachment means for the other of the first and second end panels for securing the other of the first and second end panels of the tray cover to each of the at least two trays ; (3) articulating the first tray; (4) articulating the second tray; (5) articulating the tray cover; (6) positioning the second tray adjacent the first tray so that the first and second trays are in side-by-side abutment; (7) filling the first and second trays with the articles; (8) inserting the at least one tab member of the first end panel of the tray cover between at least one of the front and back panels, and the contained articles respectively positioned within the first and second trays to, in turn, releasably secure the first end panel within each of the at least two trays; (9) attaching the second end panel of the tray cover to the other of the front and back panels to, in turn, releasably secure the second end panel to each of the at least two trays; and (10) the insertion of the at least one tab member of at least one of the first and second end panels substantially enclosing the tray cover within each of the at least two trays.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

We claim:

1. A container apparatus convertible from a shipping container having two or more trays into one or more display trays for the containment and display of articles therewithin, the container apparatus comprising:

at least two trays, each of the at least two trays successively abutting the other of the at least two trays upon articulation;

each of the at least two trays comprising:

a front panel;

a back panel substantially parallel to and opposite the front panel;

at least two side panels operably positioned between the front panel and the back panel respectively, each of the at least two side panels in substantially parallel relationship to and opposite one another;

a bottom panel operably associated with the front, back and at least two side panels;

one of the at least two side panels of one of the at least two trays juxtaposed adjacent one of the at least two side panels of the other of the at least two trays so as to position the at least two trays in the abutting side-by-side orientation;

each of the front, back and at least two side panels, upon articulation, having a height, the height of the at least two side panels being greater than the height of at least one of the front and back panels so as to allow articles contained therewithin to be visible for inspection and for facilitated accessibility;

a tray cover having a top panel, a first end panel and a second end panel opposite the first end panel, at least one of the first and second end panels having at least one tab member, the at least one tab member capable of being configured for insertable engagement between the articles contained within the at least two trays and at least one of the front and back panels, respectively, in each of the at least two trays to, in turn, releasably secure the tray cover within each of the at least two trays; and attachment means for the other of the first and second end panels for securing the other of the first and second end panels of the tray cover to each of the at least two trays.

2. The apparatus according to claim 1 wherein each of the at least one tab member further comprises at least two lobes for facilitating insertable engagement between the articles and at least one of the front and back panels, respectively, of each of the at least two trays.

3. The apparatus according to claim 2 wherein each of the at least two lobes further includes a releasable attachment member which is capable of releasably mating engagement with a portion of at least one of the front and back panels respectively, after insertion of the first and second end panels between the articles and the front and back panels respectively, of each of the at least two trays and which remains engaged with the portion of the at least one of the front and back panels respectively, after the attached at least one of the first and second end panels is disengaged from the one of the front and back panels.

4. The apparatus according to claim 1 wherein the height of the at least two side panels is greater than the height of at least a portion of both of the front and back panels so as to allow articles contained therewithin to be visible for inspection and for facilitated accessibility.

5. The apparatus according to claim 1 wherein the front panel and the back panel of each of the at least two trays have substantially the same height and configuration.

6. The apparatus according to claim 1 wherein the height of the front panel of each of the at least two trays is greater than the height of the back panel of each of the at least two trays.

7. The apparatus according to claim 1 wherein the height of the back panel of each of the at least two trays is greater than the height of the front panel of each of the at least two trays.

8. The apparatus according to claim 1 wherein each of the at least two side panels of each of the at least two trays includes a side-front panel and a side-back panel in substantially opposed, parallel relationship with one another upon articulation, with the side-front and side-back panels of each of the at least two trays having substantially the same height as the at least two side panels.

9. The apparatus according to claim 1 wherein the first end panel and the second end panel of the tray cover have substantially the same configuration.

10. The apparatus according to claim 1 wherein the tray cover includes a line of frangibility for separating the first and second trays oriented symmetrically across the tray cover so as to substantially coincide with and abut the at least two abutting side panels of the at least two trays, and being capable of allowing the apparatus to be separated in a facilitated manner into two or more display trays, without preliminarily removing the tray cover.

11. The apparatus according to claim 10 wherein the line of frangibility is a line of perforation.

12. The apparatus according to claim 1 wherein at least a portion of the top panel of the tray cover includes printed advertising material.

13. The apparatus according to claim 1 wherein the tray cover includes a rotatable display header which enables advertising material printed thereon to be visible to the consumer and to allow the tray cover to serve as a point-of-purchase display upon removal of at least one of the front and back panels from between the at least one of the front and back panels and the articles.

14. The apparatus according to claim 1 wherein the attachment means for securing the other of the first and second end panels to the first and second end panels of the tray cover comprises an attachment strip.

15. The apparatus according to claim 1 wherein the attachment means for securing the other of the first and second end panels to the first and second end panels of the tray cover comprises at least one tab member.

16. The apparatus according to claim 1 wherein the first end panel comprises an attachment strip and the second end panel comprises at least one tab member.

17. The apparatus according to claim 1 wherein the first end panel comprises at least one tab member and the second end panel comprises an attachment strip.

18. The apparatus according to claim 1 wherein each of the at least two trays includes four side panels operably positioned between the front panel and the back panel respectively, each of two side panels juxtaposed and overlapping the other of the two side panels for providing additional structural and stacking strength to each of the at least two trays.

19. The apparatus according to claim 1 wherein each of the at least two side panels of each of the at least two trays includes a corner-reinforcement member which comprises three contiguous corner region members which, upon articulation, form the corner-reinforcement member to provide additional structural and stacking strength to each of the at least two trays.

20. The invention according to claim 1 wherein each of the at least two trays and the tray cover is each formed of substantially flat blanks of material.

21. The invention according to claim 20 wherein the substantially flat blanks of material comprise paper material.

22. The invention according to claim 21 wherein each of the paper material comprises corrugated paperboard.

23. A method for forming a container apparatus convertible from a shipping container having two or more trays into one or more display trays for the containment and display of articles therewithin, the method comprising the steps of:

forming a first tray and a second tray from at least one substantially flat blank of material for each, each of the first and second trays comprising a front panel, a back panel substantially parallel to and opposite the front panel, at least two side panels operably positioned between the front panel and the back panel respectively, each of the at least two side panels in substantially parallel relationship to and opposite one another, one of the at least two side panels of one of the at least two trays juxtaposed adjacent one of the at least two side panels of the other of the at least two trays so as to position the at least two trays in the abutting side-by-side orientation, each of the front, back and at least two side panels, upon articulation, having a height, the height of the at least two side panels being greater than the height of at least one of the front and back panels so as to allow articles contained therewithin to be visible for inspection and for facilitated accessibility, and a bottom panel operably associated with the front, back and at least two side panels;

forming a tray cover having a top panel, a first end panel and a second end panel opposite the first end panel, each of the first and second end panels having at least one tab member, the at least one tab member capable of being configured for insertable engagement between the articles contained within the at least two trays and at least one of the front and back panels, respectively, in each of the at least two trays to, in turn, releasably secure the tray cover within each of the at least two trays, and further having attachment means for the other of the first and second end panels for securing the other of the first and second end panels of the tray cover to each of the at least two trays;

articulating the first tray;

articulating the second tray;

articulating the tray cover;

positioning the second tray adjacent the first tray so that the first and second trays are in side-by-side abutment;

filling the first and second trays with the articles;

inserting the at least one tab member of the first end panel of the tray cover between at least one of the front and back panels, and the contained articles respectively positioned within the first and second trays to, in turn, releasably secure the first end panel within each of the at least two trays;

attaching the second end panel of the tray cover to the other of the front and back panels; and the insertion of the at least one tab member of at least one of the first and second end panels substantially enclosing the tray cover within each of the at least two trays.

* * * * *